United States Patent [19]

Joerg et al.

[11] Patent Number: 4,947,521

[45] Date of Patent: Aug. 14, 1990

[54] COMBING MACHINE

[75] Inventors: Andreas Joerg, Neftenbach; Giancarlo Mondini, Winterthur, both of Switzerland

[73] Assignee: Rieter Machine Works Ltd., Winterthur, Switzerland

[21] Appl. No.: 409,365

[22] Filed: Sep. 19, 1989

[30] Foreign Application Priority Data

Oct. 3, 1988 [CH] Switzerland ..... 03678/88

[51] Int. Cl.[5] ..... D01G 19/16

[52] U.S. Cl. ..... 19/235; 19/225; 19/226

[58] Field of Search ..... 19/215–235

[56] References Cited

U.S. PATENT DOCUMENTS

| | | | |
|---|---|---|---|
| 1,605,135 | 11/1926 | Nasmith | 19/228 |
| 2,781,556 | 2/1957 | Foster | 19/223 |
| 3,435,486 | 4/1969 | Itoh | 19/215 |
| 3,479,699 | 11/1969 | Kaenel et al. | 19/223 |

FOREIGN PATENT DOCUMENTS

| | | | |
|---|---|---|---|
| 433333 | 8/1926 | Fed. Rep. of Germany . | |
| 1302991 | 7/1962 | France . | |
| 2636174 | 7/1977 | Japan | 19/215 |
| 843670 | 8/1960 | United Kingdom | 19/220 |

OTHER PUBLICATIONS

Patent Abstracts of Japan, vol. 10, No. 178 (C-355 2234), Jun. 21, 1986 and JP-A-61-28022, Feb. 7, 1986 of Toyoda Autom Loom Works Ltd.

Patent Abstracts of Japan, vol. 10, No. 292 (C-376 2348), Oct. 3, 1986 and JP-A-61 ∝ 108727, May 27, 1986 of Howa Mach Ltd.

*Primary Examiner*—Werner H. Schroeder
*Assistant Examiner*—John J. Calvert
*Attorney, Agent, or Firm*—Werner W. Kleeman

[57] ABSTRACT

The combing machine comprises a nipper unit possessing a bottom nipper and a top nipper which is pivotable relative to the bottom nipper about a pivot axle. An additional nipper is pivotable relative to the bottom nipper about a shaft or journal which extends at a suitable distance from and substantially parallel to the pivot axle of the top nipper. The additional nipper is coupled to the top nipper by means of at least one link. In this manner, pivoting movements of the top nipper cause the additional nipper to be pivoted each time in the opposite direction with respect to the direction of motion of the bottom nipper. When the nipper unit is in an advanced end position, the top nipper is open and the additional nipper is closed. The additional nipper firmly holds the lap, and a tuft combed out of the latter is detached by a detaching roll. No separate pivot drive is required for the additional nipper.

13 Claims, 2 Drawing Sheets

COMBING MACHINE

BACKGROUND OF THE INVENTION

The present invention relates to a new and improved construction of a combing machine provided with a nipper unit comprising a bottom or lower nipper and a top or upper nipper which is pivotable relative to the bottom or lower nipper about a pivot axle. The nipper unit, which is movable between a closed retracted end position and an open advanced end position, also comprises an additional nipper which is pivotable relative to the bottom or lower nipper such that, when the nipper unit is in its open advanced end position, a sliver or the like to be combed is clamped between the bottom or lower nipper and the additional nipper.

Combing machines of this type are known. In the closed retracted end position of the nipper unit in prior art combing machines, a fiber tuft is clamped between the bottom or lower nipper and the top or upper nipper and combed out by a rotating circular comb. The nipper unit is then moved into the open advanced end position thereof and the combed-out tuft is united with the previously combed-out lap at a detaching roll or roller. Such detaching roll or roller then pulls the combed-out tuft through a top comb. The additional nipper is thereby lowered to the lap located on the bottom or lower nipper, in order to substantially prevent fiber tufts, which have not yet been combed out by the rotating circular comb, from being detached together with the combed-out tuft.

In the heretofore known combing machines of the aforementioned kind the additional nipper is pivotable relative to the bottom or lower nipper about the same axle or pivot as the top or upper nipper. Since the top or upper nipper and the additional nipper are provided each with a separate drive unit or means, the construction is relatively complicated and requires a corresponding constructional expenditure.

SUMMARY OF THE INVENTION

Therefore, with the foregoing in mind, it is a primary object of the present invention to provide a new and improved construction of combing machine which does not suffer from the aforementioned drawbacks and shortcomings of the prior art constructions.

Another and more specific object of the present invention aims at providing a new and improved construction of combing machine of the previously mentioned type wherein the construction of the nipper unit and, more particularly, of the means for pivoting the additional nipper is substantially simplified.

It has been discovered that these objects can be achieved in a very simple manner in that the required pivoting movements of the additional nipper with respect to the bottom or lower nipper can be derived from the pivoting movements of the top or upper nipper, provided that the shaft or journal of the additional nipper is separated from the pivot axle of the top or upper nipper.

Now in order to implement these and still further objects of the present invention, which will become more readily apparent as the description proceeds, the combing machine of the present invention is manifested, among other things, by the features that the additional nipper is pivotable relative to the bottom or lower nipper about a shaft or journal which extends at a suitable distance from and substantially parallel to the pivot axle of the top or upper nipper, the additional nipper being coupled to the top or upper nipper in such a manner that, by pivoting movements of the top or upper nipper relative to the bottom or lower nipper, the additional nipper is pivoted each time in the opposite direction with respect to the direction of motion of the bottom or lower nipper.

The shaft or journal of the additional nipper can be appropriately located in front or downstream of the pivot axle of the top or upper nipper as viewed in the direction of travel of the nipper unit from the closed retracted end position to the open advanced end position thereof. More particularly, the additional nipper can be advantageously arranged to be pivotable about the shaft of a feed roll or roller which is rotatably mounted at the bottom or lower nipper. However, other locations of the shaft or journal of the additional nipper are likewise possible, even at the rear or upstream of the pivot axle of the top or upper nipper as viewed in the direction of travel of the nipper unit from the closed retracted end position to the open advanced end position thereof.

The additional nipper can be appropriately coupled in very simple manner to the top or upper nipper by means of at least one link or linkage element. Alternatively, it is also readily conceivable to provide, for example, two intermeshing gear wheels or toothed segments for the coupling action, one gear wheel or toothed segment being fixedly coupled to the top or upper nipper and the other gear wheel or toothed segment to the additional nipper.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
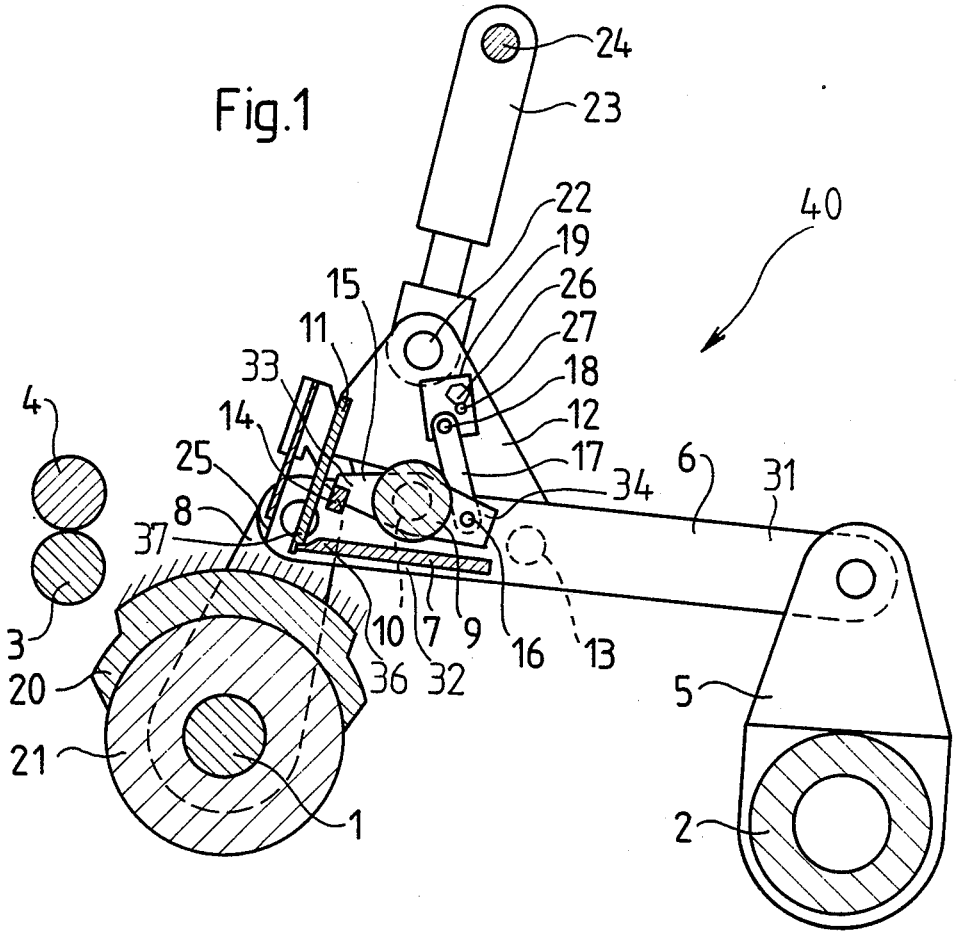
FIG. 1 is a schematic side view, partially in section, of a nipper unit of a combing machine, the nipper unit being in a closed retracted end position.

Describing now the drawings, it is to be understood that to simplify the showing thereof, only enough of the combing machine has been illustrated therein as is needed to enable one skilled in the art to readily understand the underlying principles and concepts of this invention. Turning attention now specifically to FIGS. 1 and 2 of the drawings, a nipper unit 40 of a combing machine shown therein by way of example and not limitation will be seen to comprise a continuously rotating circular-comb shaft 1, a reciprocatingly rotating nipper shaft 2 which is substantially parallel to the continuously rotating circular-comb shaft 1, a detaching roll or roller 3 and a detaching pressure roll or roller 4. All these parts or components are mounted at a machine frame which is not particularly shown in the drawings in order to simplify the illustration thereof. The reciprocatingly rotating nipper shaft 2 supports nipper crank arms 5. The rear end 31 of a bottom or lower nipper frame 6 is pivotably mounted at the nipper crank arms 5. This bottom or lower nipper frame 6 comprises a bottom or lower nipper plate 7. The front end 32 of the bottom or lower nipper frame 6 is pivotably mounted at a front support 8 which is pivotable about the axis of the continuously rotating circular-comb shaft 1. In the bottom or lower nipper frame 6 a suitable feed roll or roller 9 is rotatably mounted at a shaft or journal 10 located above the bottom or lower nipper plate 7.

The bottom or lower nipper plate 7 operatively cooperates with a top or upper nipper plate 11 held at both ends thereof by respective top or upper nipper arms or arm members 12 which are pivotably connected to the bottom or lower nipper frame 6 so as to be pivotable about a pivot axle 13.

Figure 2:
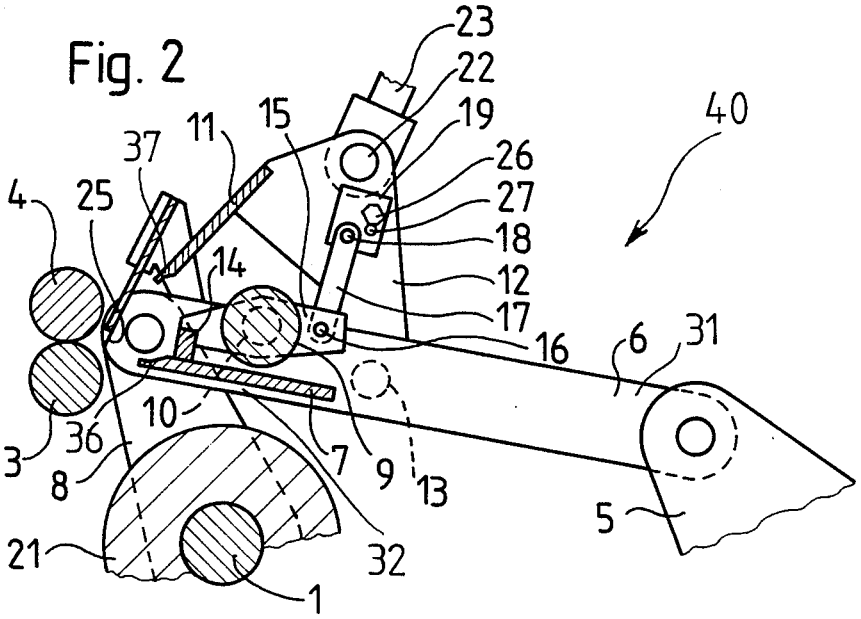
FIG. 2 shows a fragmentary schematic side view partially in section, of the nipper unit of the combing machine in FIG. 1, the nipper unit being in an open advanced end position.

In FIGS. 1 and 2 the nipper unit 40 is conveniently schematically depicted only from one side to facilitate the illustration and improve clarity thereof. It is to be understood that a mirror-image arrangement or essentially similar structure of that shown in FIGS. 1 and 2 also is present at the oppositely situated side of the nipper unit 40.

An additional nipper is pivotably connected to the bottom or lower nipper frame 6 and is pivotable about an axis which extends at a suitable distance from and substantially parallel to the pivot axle 13 of the top or upper nipper arms or arm members 12. In the exemplary embodiment of the nipper unit 40 depicted in FIGS. 1 and 2, the additional nipper comprises a lap hold-down strip 14 secured at each end thereof to a leading or front arm 33 of a respective double-armed lever 15 which is pivotable about the shaft or axle 10 of the feed roll or roller 9. One end of a link or linkage element 17 is pivotably mounted by means of a pin or journal 16 at a trailing or rear arm 34 of the double-armed lever 15, the other end of this link or linkage element 17 being pivotably connected by means of a pin or journal 18 to a bearing block 19 or equivalent structure mounted at the associated top or upper nipper arm or arm member 12.

When the nipper unit 40 comprising the bottom or lower nipper frame 6, the bottom or lower nipper plate 7, the top or upper nipper plate 11 and the top or upper nipper arms 12 is in a rear end position depicted in FIG. 1, the nipper unit 40 is closed. A fiber tuft not particularly shown in the drawings is firmly clamped between a front edge 36 of the bottom or lower nipper plate 7 and a front edge 37 of the top or upper nipper plate 11 and is combed out by a circular-comb segment 20 at a circular-comb roll or roller 21 mounted at the continuously rotating circular-comb shaft 1.

The lower nipper comprising the bottom or lower nipper frame 6 and the bottom or lower nipper plate 7 is then moved into an advanced end position depicted in FIG. 2, in which position the nipper unit 40 is open. The upper nipper arm or shaft member 12 is connected by means of a journal 22 to the lower end of a link or linkage element 23, the upper end of which is pivotably mounted at a shaft or shaft member 24 which is firmly secured to the machine frame not particularly shown in the drawings.

During the forward movement of the nipper unit 40, the links or linkage elements 23 lift the top or upper nipper arms or arm members 12 with the top or upper nipper plate 12 thereat into the open advanced end position depicted in FIG. 2. In this manner, the top or upper nipper arms or arm members 12 are pivoted, as viewed in FIG. 2, in clockwise direction relative to the bottom or lower nipper frame 6. The link or linkage element 17 simultaneously raises the trailing or rear arm 34 of the double-armed lever 15, so that the latter is rotated in anticlockwise direction relative to the bottom or lower nipper frame 6 and, accordingly, the lap hold-down strip 14 is lowered onto the bottom or lower nipper plate 7. The lap hold-down strip 14 clamps the lap to be combed, such lap arriving from the feed roll or roller 9, against the bottom or lower nipper plate 7, i.e. in front of the feed roll or roller 9 and at a short distance behind the front edge 36 of the bottom or lower nipper plate 7 as viewed in the direction of the forward movement of the nipper unit 40 from the retracted end position to the advanced end position.

The tuft combed out by the circular-comb segment 20 is then united with the previously combed-out lap at the detaching roll or roller 3. This detaching roll or roller 3 cooperates with the detaching pressure roll or roller 4 and draws off the lap through a top comb 25 supported at the bottom or lower nipper frame 6. In this manner, the combed-out tuft is disengaged from the lap which is clamped under the lap hold-down strip 14 and is still to be combed.

The nipper unit 40 is then returned to the rear end position as depicted in FIG. 1. The nipper unit 40 thereby closes and the links or linkage elements 17 lift the lap hold-down strip 14 away from the bottom or lower nipper plate 7. During the forward travel or return travel of the nipper unit 40 the feed roll or roller 9 can forwardly advance or pass further laps for combing under the raised lap hold-down strip 14.

The open advanced end position of the nipper unit 40 in the combing machine shown in FIG. 2, and consequently the spacing between the detaching roll or roller 3 and the front edge 36 of the bottom or lower nipper plate 7 in its front end position, is usually adjustable. To ensure that in each and every adjustable open advanced end position the lap hold-down strip 14 clamps the lap in the desired manner at the bottom or lower nipper plate 7, re-adjustment or compensation may be required because, in the event of a change of the open advanced end position, there is also a change in the opening angle of the upper nipper comprising the top or upper nipper arms or arm members 12 with the top or upper nipper plate 11 thereat. Various possible means to this end will be discussed hereinafter. Of course, two or more of these possibilities can be applied in combination.

In the exemplary embodiment of the nipper unit 40 depicted in FIGS. 1 and 2 the bearing block 19 or equivalent structure is mounted at the top or upper nipper arm or arm member 12 to be appropriately elevationally adjustable, for example, by means of a screw 26 or the like which extends through a slot or elongated hole 27 in the bearing block 19. This bearing block 19 is elevationally adjusted such that in the open advanced end position of the nipper unit 40 the lap hold-down strip 14 assumes the desired position with respect to the bottom or lower nipper plate 7.

It is evident that the same adjustability can also be obtained in that the lower pin or journal 16 is arranged in a bearing bracket which is appropriately elevationally adjustable relative to the double-armed lever 15.

Alternatively, a desired clamping force of the lap hold-down strip 14 can be obtained in various open advanced end positions if the links or linkage elements 17 are replaced by resilient links of variable length.

Figure 3:
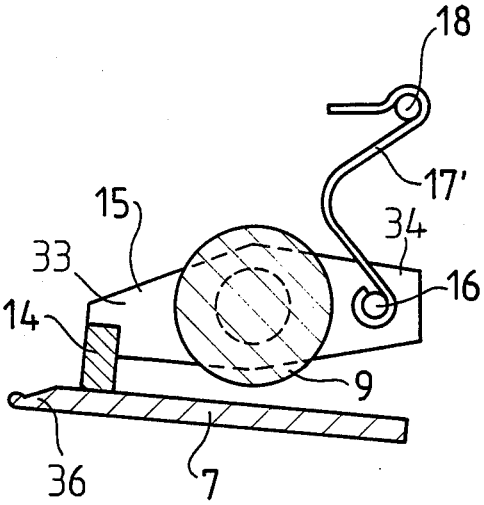
FIG. 3 schematically shows on an enlarged scale and in partially sectional side view a first variant of an additional nipper and means for coupling the latter to the top or upper nipper of the nipper unit.

FIG. 3 shows, by way of example, a link or linkage element 17' in the form of a spring clip. The upper pin or journal 18 can be fixidly connected to the associated top or upper nipper arm or arm member 12 which is not shown in FIG. 3 in order to simplify the illustration.

Figure 4:
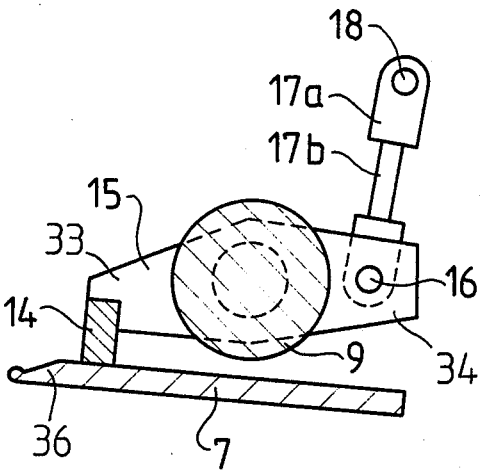
FIG. 4 schematically shows on an enlarged scale and in partially sectional side view a second variant of an additional nipper and means for coupling the latter to the top or upper nipper of the nipper unit.

FIG. 4 shows a link or linkage element 17 comprising two parts or portions 17*a* and 17*b* which are axially or linearly movable relative to each other and pulled toward one another by a built-in tension spring for linear adjustment not particularly shown in the drawing.

Alternatively, the tension spring can be dispensed with if suitable means not particularly shown in the drawings are provided for appropriately positioning the two parts or portions 17*a* and 17*b* relative to one another in a set position, i.e. at a set length of the link or linkage element 17 comprising the two parts or portions 17*a* and 17*b*.

Figure 5:
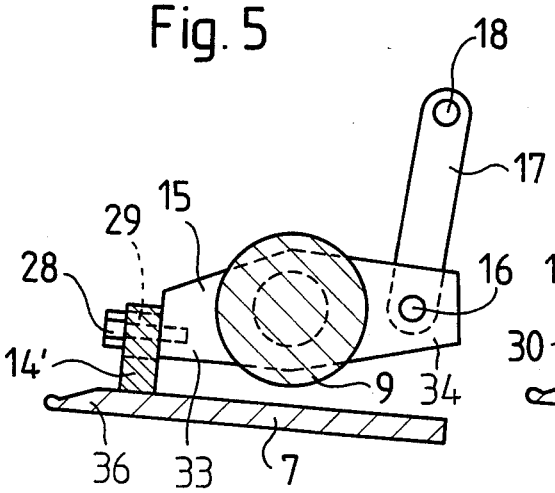
FIG. 5 schematically shows on an enlarged scale and in partially sectional side view a third variant of an additional nipper and means for coupling the latter to the top or upper nipper of the nipper unit.

In a variant depicted in FIG. 5 a lap hold-down strip 14' is fastened to the leading or front arm 33 of the double-armed lever 15 so as to be elevationally adjustable, for example, by means of a screw 28 or the like which extends through a slot or elongate hole 29 in the lap hold-down strip 14'. The vertical position of the lap hold-down strip 14' is adjusted such that in the open advanced or front-end position of the nipper unit 40 the lap hold-down strip 14' assumes the desired position or location relative to the bottom or lower nipper plate 7, in order to clamp the lap at the latter.

Figure 6:
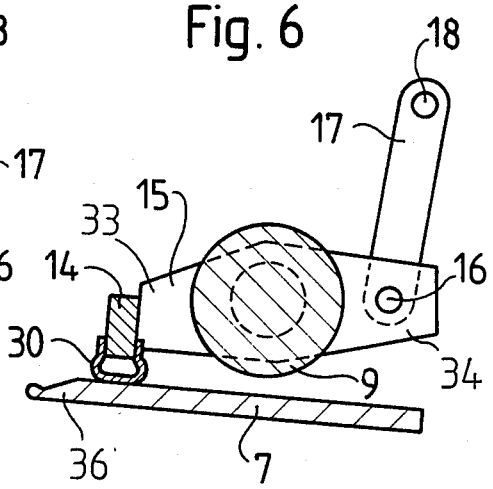
FIG. 6 schematically shows on an enlarged scale and in partially sectional side view a fourth variant of an additional nipper and means for coupling the latter to the top or upper nipper of the nipper unit.

In the variant according to FIG. 6 an element 30 is provided at the underside or lower surface of the lap hold-down strip 14, such element 30 being resilient or spring-mounted relative to the lap hold-down strip 14, for example, a section member of elastomeric material having edges secured to the lap hold-down strip 14. At each and every open advanced end position of the nipper unit 40, the element 30 always presses the lap onto the bottom or lower nipper plate 7 with approximately uniform force.

In the variants depicted in FIGS. 3 through 6 the lap hold-down strip 14 possesses an approximately rectangular cross-section. It is readily conceivable that other shapes or forms of cross-section, for example, lap hold-down strips having a substantially circular cross-section, are likewise possible.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A combing machine, comprising:

a nipper unit containing a bottom nipper and a top nipper;

said nipper unit having a closed retracted position and an open advanced position;

said nipper unit being movable between said closed retracted position and said open advanced position;

a pivot axle for said top nipper;

said top nipper being pivotable relative to said bottom nipper about said pivot axle;

an additional nipper which is pivotable relative to said bottom nipper in order to clamp, in said open advanced position of said nipper unit, between said bottom nipper and said additional nipper a sliver to be combed;

a shaft which extends at a distance from and substantially parallel to said pivot axle of said top nipper;

said additional nipper being pivotable relative to said lower nipper about said shaft;

said top nipper carrying out pivoting movements relative to said bottom nipper; and means for coupling said additional nipper to said top nipper such that said additional nipper is pivoted by said pivoting movements of said top nipper each time in the opposite direction relative to said bottom nipper.

2. The combing machine as defined in claim 1, wherein:

said nipper unit has a predetermined direction of travel from said closed retracted position to said open advanced position; and said shaft of said additional nipper being located in front of said pivot axle of said top nipper as viewed in said predetermined direction of travel from said closed retracted position to said open advanced position.

3. The combing machine as defined in claim 2, wherein:

said coupling means comprises at least one link; and said at least one link serving to couple said additional nipper to said top nipper.

4. The combing machine as defined in claim 3, further including:

a double-armed lever;

said double-armed lever having a leading arm and a trailing arm as viewed in said predetermined direction of travel from said closed retracted position to said open advanced position;

said at least one link acting upon said trailing arm of said double-armed lever;

lap hold-down means; and said leading arm of said double-armed lever carrying said lap hold-down means.

5. The combing machine as defined in claim 4, wherein:

said at least one link is constructed as a resilient element.

6. The combing machine as defined in claim 4, wherein:

said at least one link is constructed to be linearly adjustable.

7. The combing machine as defined in claim 4, wherein:

said at least one link possesses a pivotal location at said top nipper and a pivotal location at said additional nipper; and said pivotal location at said top nipper being adjustable.

8. The combing machine as defined in claim 4, wherein:

said at least one link possesses a pivotal location at said top nipper and a pivotal location at said additional nipper; and said pivotal location at said additional nipper being adjustable.

9. The combing machine as defined in claim 4, wherein:

said at least one link possesses a pivotal location at said top nipper and a pivotal location at said additional nipper; and said pivotal location at said top nipper and said pivotal location at said, additional nipper being adjustable.

10. The combing machine as defined in claim 3, wherein:

said bottom nipper comprises a bottom nipper frame having two lateral sides;

said additional nipper comprises:

a lap hold-down strip which is substantially parallel to said shaft and possesses two end portions;

a lever pivotably mounted relative to said bottom nipper at each lateral side of said bottom nipper frame; and said lap hold-down strip being secured at said two end portions to said levers.

11. The combing machine as defined in claim 10, wherein:

said lap hold-down strip is secured in elevationally adjustable manner to said levers.

12. The combing machine as defined in claim 10, wherein:

said lap hold-down strip possesses an underside and comprises a resilient element at said underside for bearing upon the lap.

13. The combing machine as defined in claim 10, wherein:

said lap hold-down strip possesses an underside and comprises a spring-mounted element at said underside for bearing upon the lap.

* * * * *